US006402426B1

(12) United States Patent
Dooley et al.

(10) Patent No.: US 6,402,426 B1
(45) Date of Patent: Jun. 11, 2002

(54) ENGINEERED ENVIRONMENTAL STRUCTURE AND METHOD OF ITS USE

(75) Inventors: James H. Dooley, Federal Way; Justin T. Maschoff, Tacoma, both of WA (US)

(73) Assignee: Forest Concepts LLC, Federal Way, WA (US)

( * ) Notice: Subject to any disclaimer, the term of this patent is extended or adjusted under 35 U.S.C. 154(b) by 0 days.

(21) Appl. No.: 09/759,407

(22) Filed: Jan. 12, 2001

(51) Int. Cl.[7] ..... E02B 3/02

(52) U.S. Cl. ..... 405/80; 405/25; 405/30; 405/60; 405/114

(58) Field of Search ..... 405/15–17, 21, 405/23, 24, 25, 30, 35, 52, 60, 75, 78, 80, 107, 114; 114/358, 276; 256/1, 19, 13, 65

(56) References Cited

U.S. PATENT DOCUMENTS

| | | | | | |
|---|---|---|---|---|---|
| 774,901 | A | * | 11/1904 | Wright | 405/15 |
| 801,603 | A | * | 10/1905 | Neale | 405/80 |
| 1,584,766 | A | * | 5/1926 | Gordon et al. | 405/32 |
| 3,267,679 | A | * | 8/1966 | Morse | 405/35 |
| 4,255,066 | A | * | 3/1981 | Mehlum | 405/76 |
| 5,823,710 | A | | 10/1998 | Dooley | 405/29 |
| 6,247,873 | B1 | * | 6/2001 | Fukui | 405/17 |

OTHER PUBLICATIONS

Abbe, T. B. and D. R. Montgomery. Large woody debris jams, channel hydraulics and habitat formation in large rivers. *Regulated Rivers Research and Management* 12: 201–221 (1996).

Castro, J. and R. Sampson. Incorporation of large wood into engineering structures. U.S. Department of Agriculture, Natural Resources Conservation Service, Portland, Oregon, Engineering Bulletin No. 25 (Oct. 2000).

D'Aoust S. G. and R. G. Millar. Stability of ballasted woody debris habitat structures. *Journal of Hydraulic Engineering* 126 (11): 810–817 (Nov. 2000).

Slaney, P. A., R. J. Finnegan, and R. G. Millar. Accelerating the recovery of log–jam habitats: large woody debris–boulder complexes. In *Fish Habitat Rehabilitation Procedures*. Watershed Restoration Technical Circular No. 9, P. A. Slaney and D. Zaldokas eds., Water Restoration Program, British Columbia Ministry of Environment, Lands and Parks, Vancouver, B.C. (1997).

U.S. Army Corps of Engineers. Green/Duwamish River Basin Ecosystem Restoration Study, King County, Washington, Seattle: U.S. Army Corps of Engineers, Seattle District (2000).

* cited by examiner

*Primary Examiner*—Thomas B. Will
*Assistant Examiner*—Tara L. Mayo
(74) *Attorney, Agent, or Firm*—Keith D. Gehr

(57) ABSTRACT

An engineered log jam for controlling stream flow characteristics is formed from multiple layers of logs. A first layer intended to be placed parallel to stream flow consists of two or more generally parallel logs. In normal use these would be anchored to the stream bottom. A second layer of logs is placed on top of the first. This also consists of a plurality of spaced apart logs crossing the first layer. The second layer logs are angled with respect to each other to control and direct water flow passing over and through the structure. A third layer of spaced apart logs crosses the second layer logs and further acts to direct water flow. Additional layers may be used as might be dictated by the use environment. The logs are permanently joined to each other at the points of crossing.

10 Claims, 3 Drawing Sheets

ENGINEERED ENVIRONMENTAL STRUCTURE AND METHOD OF ITS USE

The present invention is a structure that can be made of small logs to simulate a natural log jam in a stream for environmental enhancement purposes. The structure may be readily assembled on site from nearby materials thereby minimizing or eliminating the need for accessibility of heavy equipment.

BACKGROUND OF THE INVENTION

For many years debris in streams, such as large logs or log jams, was regarded as a nuisance or even deleterious to stream health. It was common practice to remove this debris to permit unobstructed stream flow for ease of navigation or flood control. This thinking has changed radically in recent years as efforts to enhance fish populations and restore damaged riparian environments have gained major emphasis. Organic debris is now generally recognized as important for maintaining the biotic and abiotic functions of streams, lakes, and ponds. In streams, large woody debris has a major influence on channel form and on sediment transport and deposit patterns. The quantity of large woody debris is highly correlated with the number and spacing of pools that are critical as fish habitat. This favorable debris may be present as individual large logs or down trees or as log jams formed from an accumulation of logs with smaller brush and tree remains. In addition to providing favorable water conditions for aquatic life, this in-stream wood also provides shade and cover for refuge from predators.

An earlier patent of one of the present inventors, U.S. Pat. No. 5,823,710, describes a substitute for natural large woody debris that can be readily manufactured and transported to the site where it will be used. This product has proved to be a very effective tool for managing stream habitat and hydrology. It is formed as a hollow, generally cylindrical or frustroconical structure formed from an even number of small logs held together by wood struts mortised into the logs. The central portion may be ballasted with rocks to increase the weight and stability against movement by high water. This invention replicates the form and function of an individual large log. However, it cannot readily act to create a larger debris structure, such as a log jam, unless by chance it serves as an accumulation point for woody material floating downstream.

The effects of stream debris on aquatic life habitat and stream flow characteristics has recently received significant theoretical study. Abbe, T. B. and D. R. Montgomery, *Regulated Rivers Research and Management* 12: 201–221 (1996), describe large woody debris jams and their effect on channel hydraulics and habitat formation in large rivers. They note the long term stability over many years of individual natural log jams. The authors describe three general types of log jams and how each affects stream hydraulics.

Slaney, P. A., R. J. Finnegan, and R. G. Millar in *Fish Habitat Rehabilitation Procedures,* P. A. Slaney and D. Zaldokas eds., Watershed Restoration Technical Circular No. 9, British Columbia Ministry of Environment, Lands and Parks (1997) go into considerable detail as to the types of natural log jams and their effect on stream hydraulics. They describe two basic constructions for anchored man-made log jams. One is a single log type and the other a triangular structure. Both are cabled to bank supporting points and to large boulders introduced adjacent to and within the structures. The structures described emphasize logs buried or partially buried in the stream bank or bottom to act as anchors.

D'Aoust, S. G. and R. G. Millar, *Journal of Hydraulic Engineering,* November 2000, pp 810–817, describe the retention and stability of natural woody stream debris. They develop mathematical models of stream conditions which affect and are affected by designed ballasted large wood debris structures; e.g., such as those described by Slaney et al.

Castro, J. and R. Sampson, in a draft USDA, Natural Resources and Conservation Service, Portland, Ore., Engineering Technical Note No. 25 (October 2000), give a similar but somewhat less mathematical treatment of the subject dealt with by D'Aoust et al.

A publication by the U.S. Army Corp of Engineers, Green/Duwamish River Basin Ecosysten Restoration Study, King County Washington (2000) illustrates a number of different types of anchored debris and boulder structures for stream flow control. These require logs buried into the shoreline or stream bottom for anchoring.

Most of the systems noted above have complex anchoring systems, require relatively large logs, and/or require medium to heavy equipment for their installation. Additionally they tend to act as dams that direct water around them rather than attenuating water velocity and permitting flow through the structures. The present invention serves the need for a simple, stable, and readily on-site constructed large woody debris structure for stream enhancement.

SUMMARY OF THE INVENTION

Engineered log jams have been defined as permanent or semi-permanent structures designed to simulate natural log jams. They contain key pieces of wood which are large enough to affect the course of a river channel. Typically they are also designed to capture additional woody debris. The present invention is a structure serving as a man-made and emplaced log jam for controlling localized stream flow characteristics. It is useful for streamside erosion control, creation of pools for enhancement of habitat for aquatic life, and for rehabilitation of degraded stream locales to a more natural condition. The structures may be readily built and installed in place without the need for heavy equipment and may usually be constructed of locally available materials. They have excellent permanence and are resistant to destruction by floods and other high water events.

The term "log" is understood to be a tree stem that will have a diameter of at least about 10 cm (4 in). There is no limit to the maximum diameter and length of the logs but normally they would be of a size to be handleable by two or three persons or by very light equipment, such as a small tractor or backhoe.

The term "stream" should be read broadly to include streams from a few meters across up to large rivers.

The structures are formed by a first layer of at least two spaced apart, generally parallel logs. These are most usually placed against and anchored to the stream bottom, generally parallel to the stream flow. A second layer of logs is then placed across and on top of the first logs. These are attached to the first layer logs at the crossing points and serve to direct stream flow through and over the structure. The second layer also consists of two or more logs spaced apart from each other and angled with respect to each other so that the second layer logs are more widely separated at one end than the other. Projections along the longitudinal axes of the second layer logs will converge at some point beyond the more closely spaced ends. In use, the second layer log at the most upstream location will typically be placed across the stream flow direction. This tends to attenuate flow velocity as water passes over and/or under the log. The downstream log or logs of the second layer will be angled somewhat from the upstream log. This is to take advantage of the effect that regardless of the angle of incidence of water hitting the upstream side of a log, it will leave the log normal to the longitudinal axis. Thus, the logs forming the second layer act to adjust stream flow into a desired direction as it passes over and through the structure.

A third layer of at least two spaced apart logs is then placed so as to cross the logs of the second layer. Again, the second and third layer logs are attached to each other at the crossing points. The logs of this layer cooperate with the second layer logs to further guide water outflow in the desired direction from the structure.

Under most operating conditions, at least the first and second log layers will be underwater although this may vary with normal seasonal changes in stream flow.

It is entirely feasible to add additional log layers above the third layer. In this case, each additional layer will comprise a plurality of spaced apart logs, the logs of each layer crossing and being attached to the logs of the adjacent layers. An exception might be the use of one or more logs or other material placed atop the structure primarily to add dead weight. These may or may not be attached to some or all of the underlying logs.

In most applications the structure will be anchored to a stream bank or stream bottom using cables or other attachment means. It may also be used mid stream; e.g., as a gravel bar apex log jam. Alternatively, it may be used as a floating log jam with anchor points either mid-stream or to some adjacent point on shore. In this location it will normally be about 80% underwater. When installed adjacent a stream bank the more widely separated ends of the second layer logs will usually be oriented mid-stream.

Additional "jackstraw" logs may be inserted between the logs forming the main part of the structure. These may or may not be anchored in the stream bottom but will protrude generally vertically from the structure. Their function is to catch floating debris moving downstream and thus enlarge the structure in the manner of a natural log jam.

The structure differs in a number of important ways from those described in the prior art, both in construction and function. The orientation of the first layer logs parallel to stream flow direction greatly simplifies initial installation since it greatly reduces hydraulic resistance and it is not necessary to fight against the current. Additionally, the structure is designed so that water can flow over and through the logs, simulating a natural log jam. This has a number of advantages. Water velocity is attenuated but the water does not meet the resistance of a more solid structure acting as a dam. It also serves as a shelter for aquatic life. Fish can swim over and through the structure yet still find shade and protection from predators. Further, the structure does not require the large boulders that are an integral part of most engineered log jams known to date. These may or may not be available near the site of installation and require fairly heavy equipment to place them because of their extremely high weight.

It is an object of the invention to provide an engineered log jam that may be readily constructed on site with simple equipment.

It is another object to provide an engineered log jam that is effectively designed for hydraulic flow routing and aquatic life habitat formation.

It is a further object to provide an engineered log jam that will resist displacement from peak stream flows.

These and many other objects will become readily apparent to those skilled in the art who will readily understand the construction and operation of the invention by reference to the following detailed description taken in conjunction with the drawings.

DETAILED DESCRIPTION OF THE PREFERRED EMBODIMENTS

Figure 1:
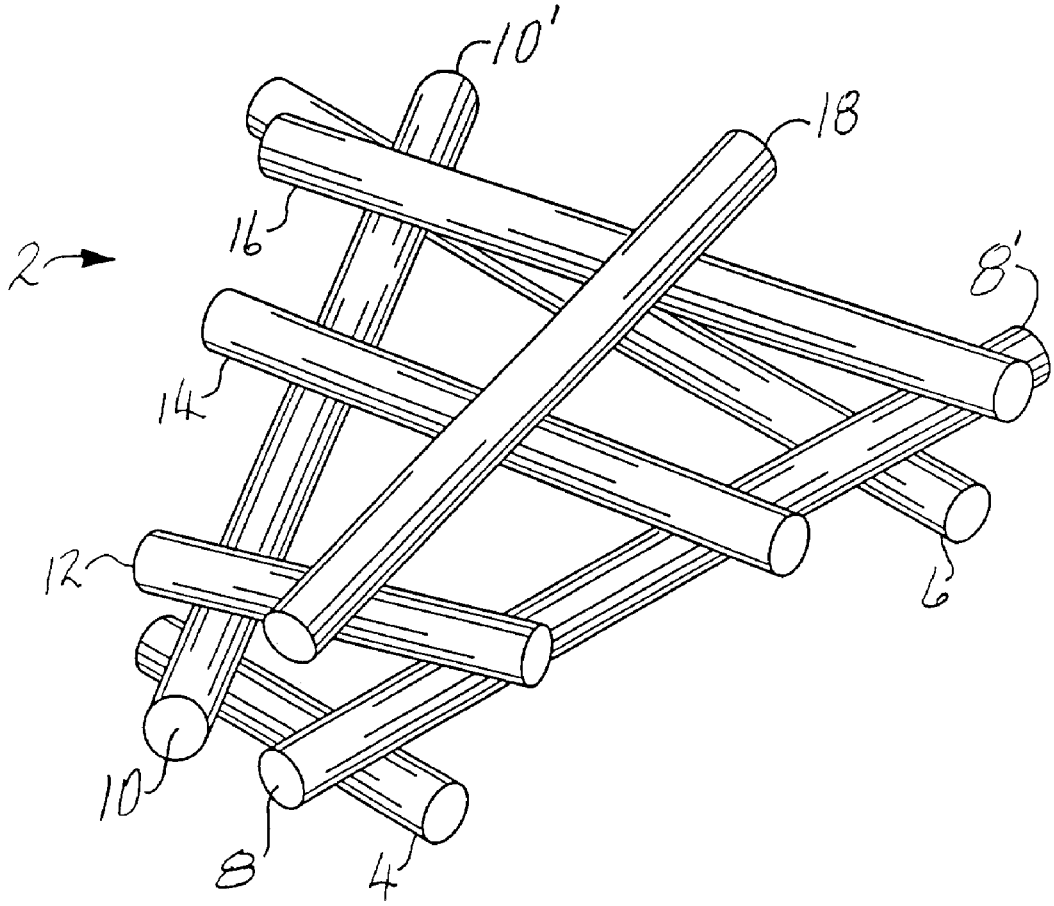
FIG. 1 is a perspective view of one version of the present log structure.

Referring to the drawings, FIG. 1 is a somewhat idealized illustration of one form of the structure 2 comprising the invention. It has a first log layer formed of logs 4, 6 that are generally parallel to each other. In use these would usually be placed adjacent the stream bottom and generally parallel to the direction of stream flow. A second log layer comprising logs 8 and 10 is placed across the lower logs. These logs are positioned so that ends 8', 10' are spaced farther apart than the opposite ends. Projections of the longitudinal axes of these logs converge. Log 8 may be at generally right angles to first layer logs 4, 6. In use in a stream log 8 would normally be on the upstream side if the structure is configured as shown.

A third layer of spaced apart logs 12, 14, 16 is placed so as to cross each log of the second layer. Additional layers may be used above the third layer, depending upon the circumstances and environment of use; e.g., in deeper streams. These additional layers would also have a plurality of logs placed so as to cross each log of the underlying layer. In FIG. 1 a single log 18 is shown atop the third layer. This log may also be functional to control stream flow or it may simply contribute dead weight to assist in holding the structure in place.

While only two logs are illustrated in the first and second layers, it will be understood that more may be used as in-stream conditions and other factors of use may require.

All the logs of each layer are permanently attached to contacting logs of adjacent layers.

Figure 2:
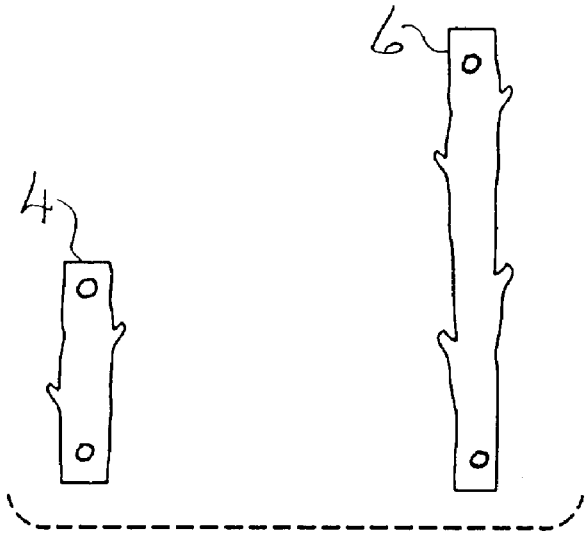
FIGS. 2–5 represent step-by-step assembly of the structure.
Figure 3:
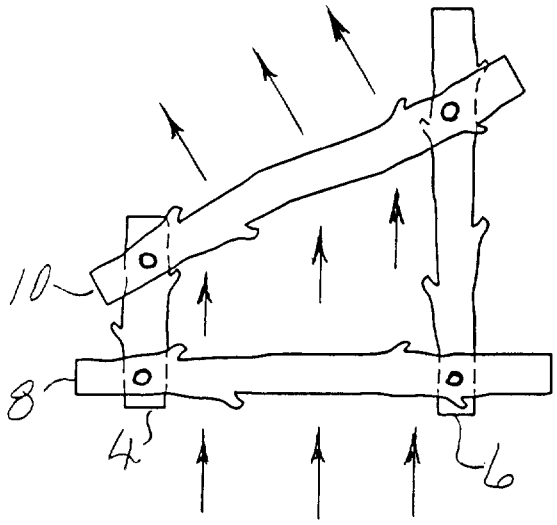
Figure 4:
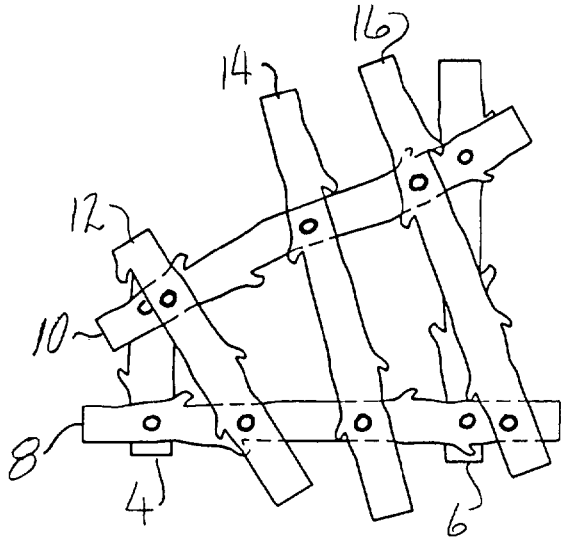
Figure 5:
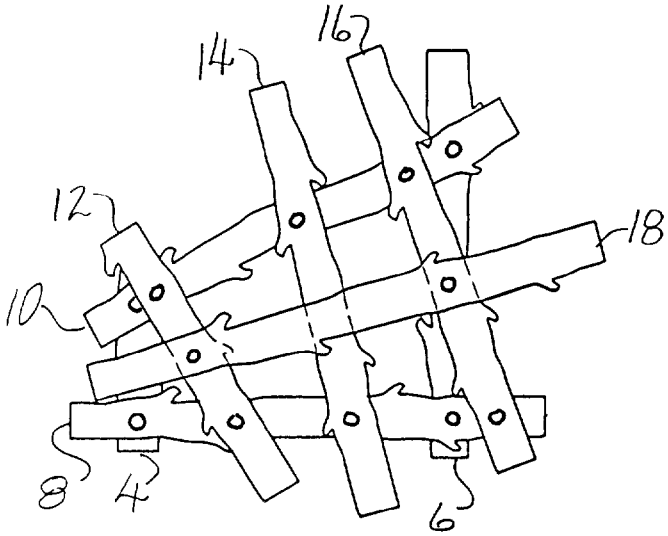

Reference to FIGS. 2 through 5 will show how the structure is assembled. In FIG. 2, logs 4 and 6 of the first layer have been located in place. These would normally be anchored to a stream bottom by any well known means. FIG. 3 shows the two logs 8, 10 of the second layer being placed atop the first layer logs. In use, log 8 might optimally be located transverse to stream flow direction, although this is not essential. FIG. 4 shows the addition of the third later logs 12, 14, 16 across the second layer logs. Finally, the top dead weight log 18 has been added, as seen in FIG. 5.

One major virtue of the structure is that it can be assembled in place either from components that are premanufactured or from small logs available at or near the site of use. This eliminates the need for road access to the site of use, a requirement that is impossible to fulfill in many locales.

Figure 6:
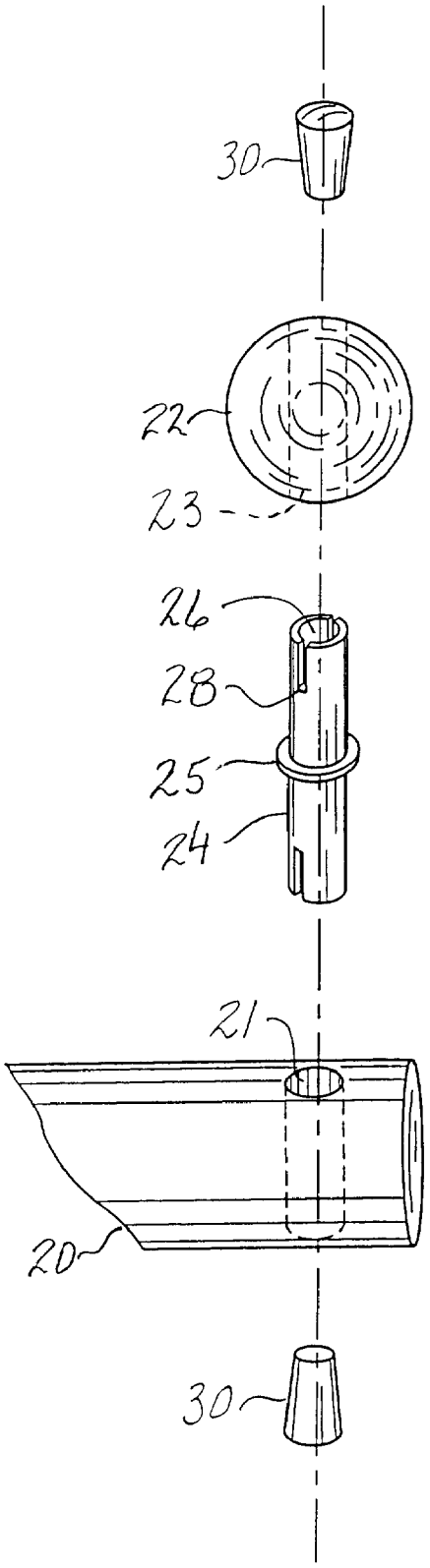
FIG. 6 is an exploded view of one method of connecting the individual log members.
Figure 7:
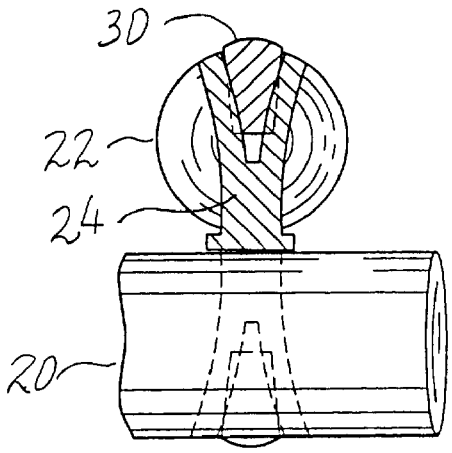
FIG. 7 is a view, partially in cross section of one pair of assembled members using the procedure of FIG. 6.
Figure 8:
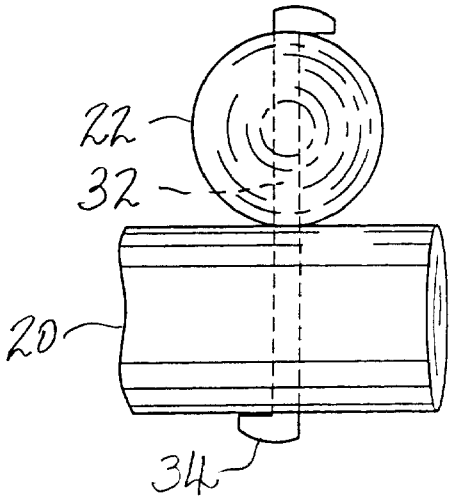
FIG. 8 shows an alternate method of assembling the individual members.

FIGS. 6–8 show two ways in which the crossing logs can be attached to each other. FIG. 6 is an exploded view showing logs 20 and 22 being joined by a spar or dowel 24. Each log has a hole bored for receipt of the dowel; e.g. hole 21 on log 20 and hole 23 in log 22. The dowel has bored-out ends 26 which are preferably kerfed or split at 28 to provide expansion capability. After assembly, as shown in FIG. 7, tapered plugs or wedges 30 are driven into the recessed dowel ends 26 to expand them permanently in place.

FIG. 8 shows another means of attaching the logs at points of crossing. A metal bar 32 having bent ends 34 is used in this example. This can conveniently be made of steel rebar that can be readily bent in the field. Other means of attaching the logs, such as spikes or cable wraps are equally satisfactory.

As shown in FIGS. 6 and 7, it is not essential for the logs of the adjacent layers to be in physical contact. They may be placed apart by a mid-portion 25 in dowel 24.

The structure shown is not simply a stack of crossing logs but is engineered on sound hydraulic principles. It is known that water crossing a log or similar object will flow away from the log at right angles to the longitudinal axis of the log, regardless of the angle of incidence of the water. This principle is used advantageously to direct stream flow as the following example will illustrate.

One situation where the structure might be used is for stabilization of a stream bank subject to undercutting or other erosion. As shown in FIG. 1, the first layer logs 4, 6 would be anchored to the stream bottom in a direction generally parallel to the direction of water flow. Second layer logs 8, 10 would then be added with the spread apart ends 8', 10' being located adjacent to the undercutting bank. Log 8 would be advantageously located upstream and transverse to stream flow to reduce water velocity as it passed over the log. As the water then passed over log 10 it would be redirected away from the bank as seen by the arrows in FIG. 3. Depending on the depth at the locale, logs 12, 14, 16, of the third layer would further be located to direct water away from the problem area.

A supplemental method of anchoring the structure might be the use of poles or "jackstraw logs" set into the stream bottom but embraced within the structure. These jackstraw logs also serve to capture debris floating downstream. This additional debris provides resistance and further reduces water velocity passing through the structure. In this manner the structure acts much as would a natural log jam to encourage formation of a pool beneath and upstream of the structure.

Many variations are possible in the construction of the structure that have not been exemplified in the drawings or description but which will readily occur to those skilled in the art. It is the intention of the inventors that these variations should be included within the scope of the invention if encompassed within the appended claims.

What is claimed is:

1. A structure simulating a log jam for controlling the stream flow characteristics which comprises:

a first log layer placed adjacent a stream bottom, the first layer comprising at least two spaced apart logs placed generally parallel to each other and to the direction of stream flow;

a second log layer for controlling the stream flow direction comprising at least two spaced apart logs placed atop and resting upon the first layer of logs, the logs of the second layer crossing and being attached to each log of the first layer, one of the second layer logs being located upstream and generally transverse to the direction of stream flow, the logs of the second layer being oriented with respect to each other so that one end of the logs is more widely separated than the other end and projections of the longitudinal axes of the logs converge; and a third log layer above the second layer to further direct stream flow, the third layer comprising a plurality of spaced apart logs placed so as to cross and rest upon the logs of the second layer, the logs of the second and third layers being attached to each other.

2. The structure of claim 1 which further includes additional layers of logs above the third layer, each additional layer comprising a plurality of logs crossing and attached to the logs of the adjacent layers.

3. The structure of claim 2 which is placed adjacent to one bank of the stream to control direction of stream outflow from the structure.

4. The structure of claim 3 in which the second log layer is oriented with the more widely separated ends adjacent the stream bank in order to direct stream flow away from the stream bank.

5. The structure of claim 1 which further includes additional jackstraw logs placed through the structure generally at right angles to the planes of the log layers, the jackstraw logs serving as anchors and stream borne debris collectors.

6. A method of creating an artificial log jam in a stream or other body of water which comprises:

placing a first log layer adjacent a stream bottom, the first layer comprising at least two spaced apart logs, the logs being generally parallel to each other and to the direction of stream flow, placing a second log layer for directing stream flow comprising at least two spaced apart logs placed atop and resting upon the first layer of logs, the logs of the second layer crossing and being attached to each log of the first layer, a first of the second layer logs being located upstream and generally transverse to the direction of stream flow, the other log or logs being downstream of the first and oriented transversely to a desired direction of stream flow, the logs of the second layer being oriented with respect to each other so that one end of the logs is more widely separated than the other end and projections of the longitudinal axes of the logs converge, and further placing a third log layer above the second layer to further direct stream flow, the third layer comprising a plurality of spaced apart logs placed so as to cross and rest upon the logs of the second layer, the logs of the second and third layers being attached to each other.

7. The method of claim 6 which further includes placing additional layers of logs above the third layer, each additional layer comprising a plurality of logs crossing and attached to the logs of the adjacent layers.

8. The method of claim 6 in which the structure is placed adjacent to one bank of the stream to control direction of stream outflow from the structure.

9. The method of claim 6 in which the second log layer is oriented with the more widely separated ends adjacent the stream bank in order to direct stream flow away from the stream bank.

10. The method of claim 6 which further includes placing additional jackstraw logs through the structure generally at right angles to the planes of the log layers, the jackstraw logs serving as anchors and stream borne debris collectors.

* * * * *